US006764238B2

(12) United States Patent
Weaver et al.

(10) Patent No.: US 6,764,238 B2
(45) Date of Patent: Jul. 20, 2004

(54) WRITING INSTRUMENT INK CARTRIDGE

(76) Inventors: Jennifer Michelle Weaver, 3518 Millvale Rd., Baltimore, MD (US) 21244; Kenneth Wayne Long, Jr., 8 Acorn Cir., Apt 301, Towson, MD (US) 21286

( * ) Notice: Subject to any disclaimer, the term of this patent is extended or adjusted under 35 U.S.C. 154(b) by 0 days.

(21) Appl. No.: 10/215,219

(22) Filed: Aug. 8, 2002

(65) Prior Publication Data

US 2004/0028463 A1 Feb. 12, 2004

(51) Int. Cl.[7] ..... A46B 5/02
(52) U.S. Cl. ..... 401/6; 401/195
(58) Field of Search ..... 401/6, 222, 195, 401/221, 192

(56) References Cited

U.S. PATENT DOCUMENTS

| | | | | | |
|---|---|---|---|---|---|
| 586,143 | A | * | 7/1897 | North | 401/250 |
| 4,162,754 | A | * | 7/1979 | Fleming | 224/165 |
| 5,584,195 | A | * | 12/1996 | Liu | 63/1.12 |

FOREIGN PATENT DOCUMENTS

| | | | | |
|---|---|---|---|---|
| FR | 2 492 738 | * | 4/1982 | 401/7 |
| GB | 816917 | * | 7/1959 | 401/192 |
| IT | 615431 | * | 1/1961 | 401/7 |

* cited by examiner

*Primary Examiner*—David J. Walczak
(74) *Attorney, Agent, or Firm*—Mishrilal Jain

(57) ABSTRACT

A writing instrument ink cartridge. Preferred is a coil or wave shaped cartridge in various colors and configurations.

9 Claims, 5 Drawing Sheets

WRITING INSTRUMENT INK CARTRIDGE

FIELD OF THE INVENTION

The present invention is related to a device that provides a decorative and functional ink refill cartridge. More particularly, the present invention is related to a writing instrument cartridge having a wavy or coil shape such that the cartridge, when placed in a fully or partially transparent or translucent hollow barrel shows the wavy or coiled nature of the cartridge, which also contains more ink than usually found in standard ink cartridge sold on the market.

BACKGROUND OF THE INVENTION

Currently ball point pens and other writing instruments utilizing an ink-containing cartridge have a small diameter cylindrical ink reservoir straight in configuration from which the ink flows by gravity toward the nib and is distributed to the instrument writing mechanism such as a ball point or felt tip point. This in turn applies an even flow of ink to the writing surface. Many writing instruments currently in use maintain a clear plastic or colored translucent plastic barrel so that any insertion therein can be seen. Thus, when the novel refill cartridge of the present invention is inserted in such a plastic barrel, it enables one to observe the inserted ink cartridge providing both an aesthetic appeal and functional purpose. The clear or translucent barrel permits the user to observe the level of the ink in the cartridge to gauge whether there is a sufficient quantity of ink within the instrument to complete the user's task. From an aesthetic standpoint, the ink refill cartridge can display different colored ink, or multicolored ink, or may itself be colored to give a colorful appearance through a clear or translucent barrel.

The quantity of ink in conventional writing instruments is limited to that which is contained within the refill. Many writing instruments are inexpensive to produce and are generally discarded once the ink has been completely exhausted through writing. The useful life of these disposable writing instruments is thus limited to the amount of time it takes to completely utilize the ink contained within the cartridge. Accordingly, there is a need to produce an ink cartridge that extends the useful life of writing instruments by providing a larger supply of ink within the pen.

There is also a need to provide an ink refill that extends the useful life of ball point pens and other writing instruments that can be housed within the available diameter of writing instruments presently on the market. Thus, it is desirable to produce a coil refill that may be housed within the current diameter of ball point pens and other writing instruments presently developed which range between 7 to 9 mm as well as larger diameter instruments such as markers and highlighters. Thus, there is a need to produce an ink cartridge that fits within the available diameter of writing instruments presently being produced in the market, which provides more ink than that of a conventional refill and is decorative and aesthetically pleasing as well.

An additional advantage of the invention is the ability to wrap the refill around the outside of the instrument barrel whereby the cartridge rests on the surface of the instrument barrel. The flexible cartridge may wrap around the entire length of the barrel or a smaller portion of it. Many present writing instruments contain a textured, soft or raised grip area located about the writing instrument covering various amounts of the surface of the instrument. This provides a convenient area in which to hold the instrument when writing or a pleasant texture along the entire barrel length, or some smaller portion thereof. An advantage of the current invention is that it combines the advantages of the increased ink capacity and aesthetically pleasing design with the opportunity for the invention to provide a raised grip area along the barrel. The external ink cartridge may be wrapped around the entire length of the writing instrument or a smaller portion of the instrument.

SUMMARY OF THE INVENTION

It is, therefore, an object of the present invention to meet these and other needs through producing an ink-containing cartridge comprising at least a portion having other than a straight configuration, such as a wavy or coiled configuration that provides a steady and consistent flow of ink by gravity to the nib and ball point or other writing tip of an ink-refill writing instrument.

It is another object of the invention to provide an ink cartridge that provides more ink within the cartridge than conventional cartridges, thus substantially extending the useful life of writing instruments.

It is still another object of the invention to provide an ink cartridge which contains more ink than conventional refills and can be housed within a conventional clear plastic or translucent plastic writing instrument barrel.

It is still another object of the invention to provide a flexible, coiled or wavy ink cartridge in a fully or partially clear or translucent plastic tube.

Another advantage of the device of the present invention is that it provides for a decorative method by which the ink within a writing instrument can be displayed.

It is yet another object of the invention to provide a writing instrument cartridge that is simple in construction, low in cost and easy to manufacture.

It is yet another object of the invention to provide a writing instrument cartridge that can be used in instruments such as gel ink pens, markers and highlighters.

Another advantage of the invention is that the coil or wave dimensions may be varied to accommodate placement for different sized writing instrument barrels.

It is still another advantage of the invention that the invention may wrap around the outside of the writing instrument in a novel and aesthetically pleasing manner.

Another advantage of the invention is that it may be placed along the outside of the instrument to provide a grip area toward the writing point of the instrument or elsewhere along the barrel of the writing instrument.

Additional advantages and novel features of the invention will be set forth in part in the description that follows, and in part will become more apparent to those skilled in the art upon examination of the following description of the drawings or upon learning by practice of the invention.

BRIEF DESCRIPTION OF THE DRAWINGS

References will now be made in detail to embodiments of the present invention, examples of which are illustrated in the accompanying drawings.

FIG. 2 is divided into zig zag pattern which lies relatively flat and is appropriate for placement within a writing instrument with an oval or elliptical diameter as further illustrated in FIG. 4. The spiral patterns which are round and spring-like are appropriate in circular or other geometrically shaped writing instruments as illustrated in FIG. 3. The overall dimensions are those identified in FIG. 1 regardless of whether the cartridge is of spiral or wavy configuration.

FIG. 3 further depicts the standard octagonal interior configuration of a conventional writing instrument barrel into which the invention could be housed.

FIG. 5 also shows the approximate dimensions of the invention as would be necessary to be placed external to the writing instrument body. FIG. 5 also illustrates one method by which the straight portion of the refill would be contained within the barrel near the writing point. The cartridge would then emerge from the interior of the barrel and wrap around a portion of the barrel. As the cartridge proceeds up the barrel, the cartridge may be inserted back into the barrel through a hole in the barrel. The amount of surface area to which the cartridge could be applied varies with the shape and design of the instrument barrel.

DETAILED DESCRIPTION OF THE INVENTION

Figure 1:
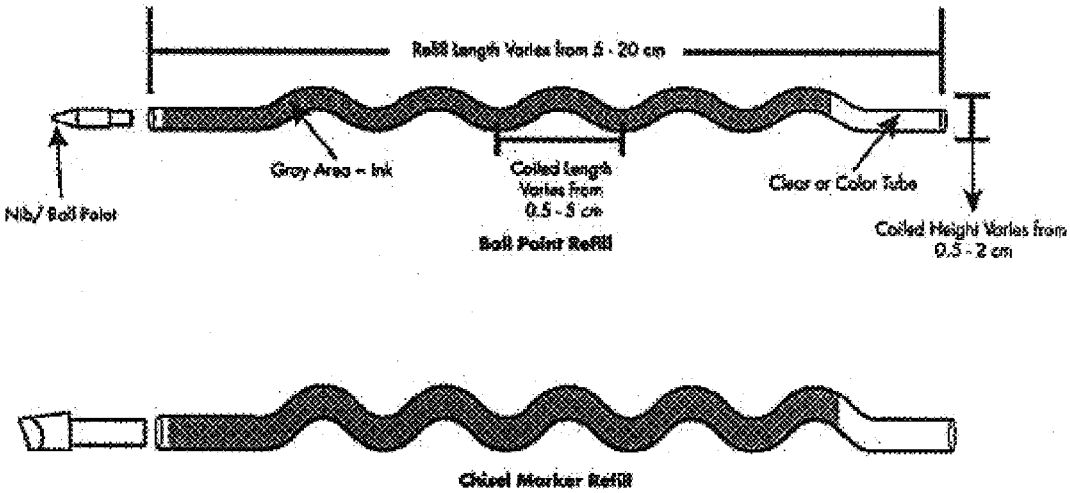
FIG. 1 identifies the parts of the invention and the overall dimensions of the inventive article illustrating the invention as applicable to a ball point pen cartridge and to a marker or highlighter with a "chisel" or felt tip.
Figure 2:
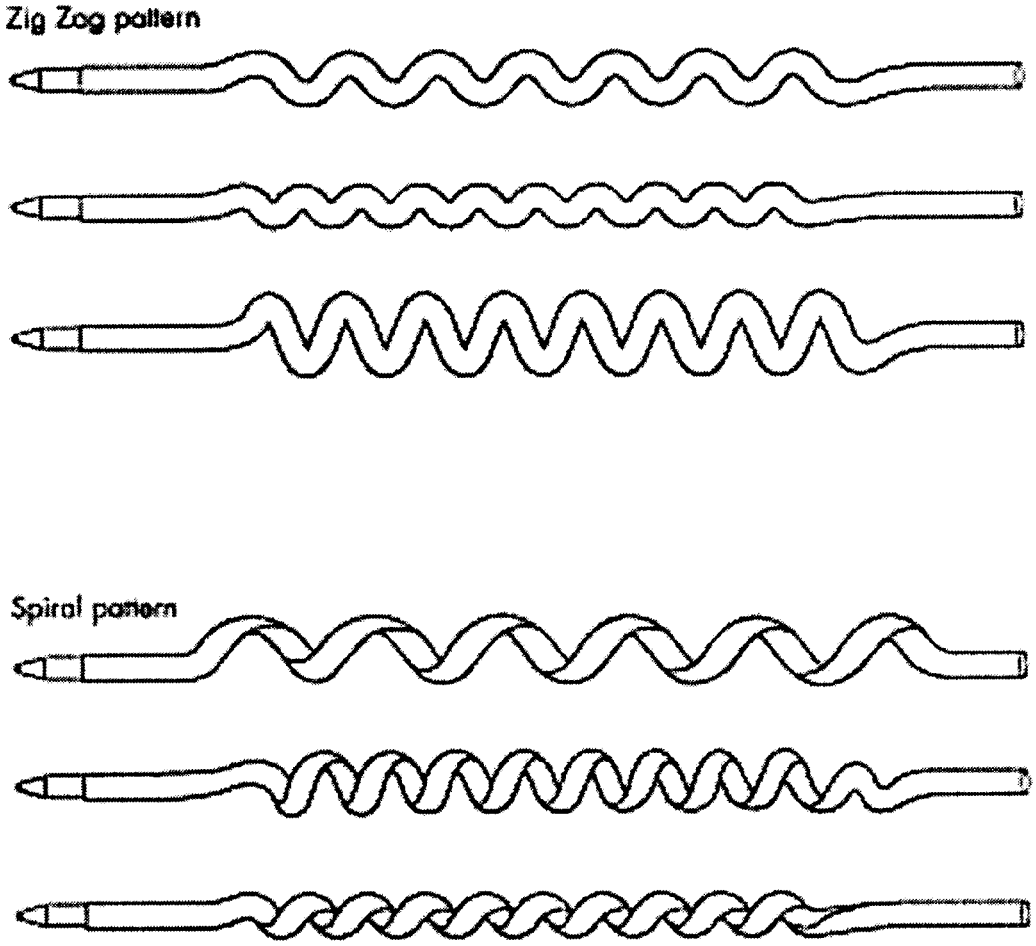
FIG. 2 shows variations in the shapes of the invention.
Figure 3:
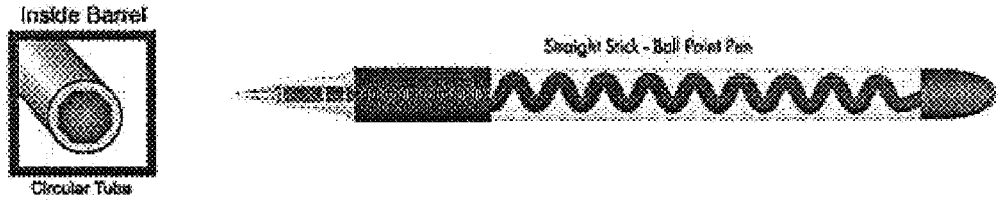
FIG. 3 illustrates the invention within a stick-type clear plastic barrel ball point pen.

The invention includes a device comprising a writing instrument ink cartridge which is open-ended at the top of the cartridge and which proceeds in a two dimensional wavy or zig zag pattern or spirals in tight or loose three dimensional coils along the length of the cartridge and straightens out where the cartridge attaches to the nib or other writing instrument point. See FIGS. 1 and 2. The inventive device may be inserted into the interior of the writing instrument as depicted in FIG. 3 or some or all of the device may be wrapped around the exterior of the instrument barrel as demonstrated in FIG. 5. The cartridge refill may also be applied to highlighters and markers, See FIGS. 1 and 4.

It should be understood that unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the methods and materials described herein are preferred. Unless mentioned otherwise, the techniques employed or contemplated herein are standard methodologies well known to one of ordinary skill in the art. The materials, methods and examples are only exemplary and not limiting.

The term "coil" or "coiled" as used herein means any spiral configuration along the entire length or any portion of the refill, without regard to the tightness of the spiral.

The term "cartridge" as used herein means any self-contained reservoir of ink contained within or without the body of a writing instrument. This term includes the nib, point or tip used to distribute the ink onto the writing surface.

The term "zig zag" or "wavy" as used herein refers to the shape of the invention and means a two dimensional wave such as a geometric sine curve whereby the invention will lie flat on a flat surface. These terms are not limited by the uniformity or dimensions of the peaks and troughs along the length of the invention.

The term "ball point pen" includes gel ink pens.

The term "marker" or "highlighter" includes all such categories of writing instruments commonly found on the market including liquid ink instruments.

In a preferred embodiment of the invention, the device comprises a clear or translucent tubular product which contains ink for a writing instrument within a coiled refill. Additionally, the device may be transferred from article to article or affixed to the article either temporarily or permanently.

The refill cartridge of the present invention can be configured or designed into a variety of different degrees of coil or wave pattern ranging from a gentle coil or wave with very few turns to a much more tightly coiled or wavy cartridge with many turns along the length of the refill. See FIG. 2. The barrel housing the device can be expanded to allow for larger coils, or widened either uniformly or randomly to accommodate a larger pen barrel styles, shapes, sizes and designs. See FIG. 4. The cartridge may be colored using colored ink or the tube material could be produced as a translucent colored material. The cartridge may contain colored or glittering ink and may be refillable ink.

Figure 4:
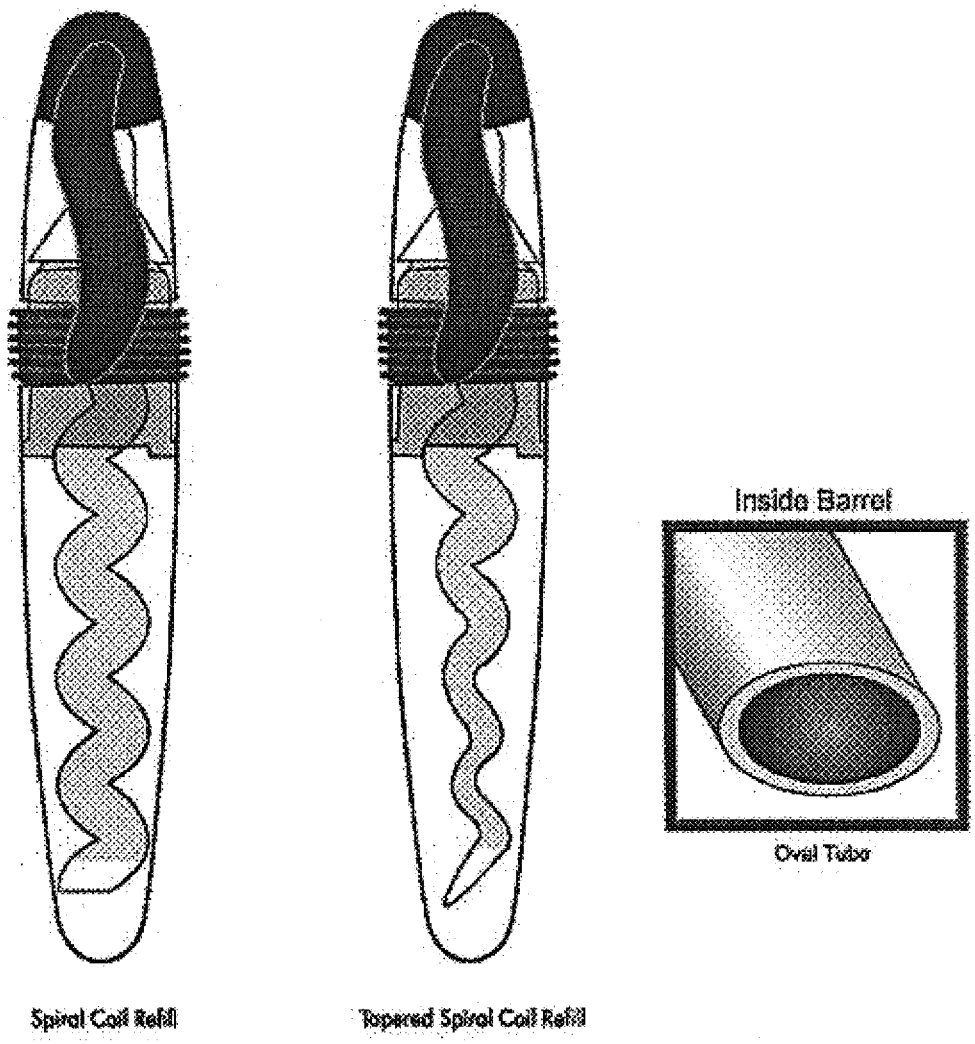
FIG. 4 demonstrates the application of the invention to a highlighter or marker type writing instrument with an elliptical shaped barrel. The invention may be of consistent diameter throughout the body of the instrument or may taper toward the end opposite the writing tip.
Figure 5:
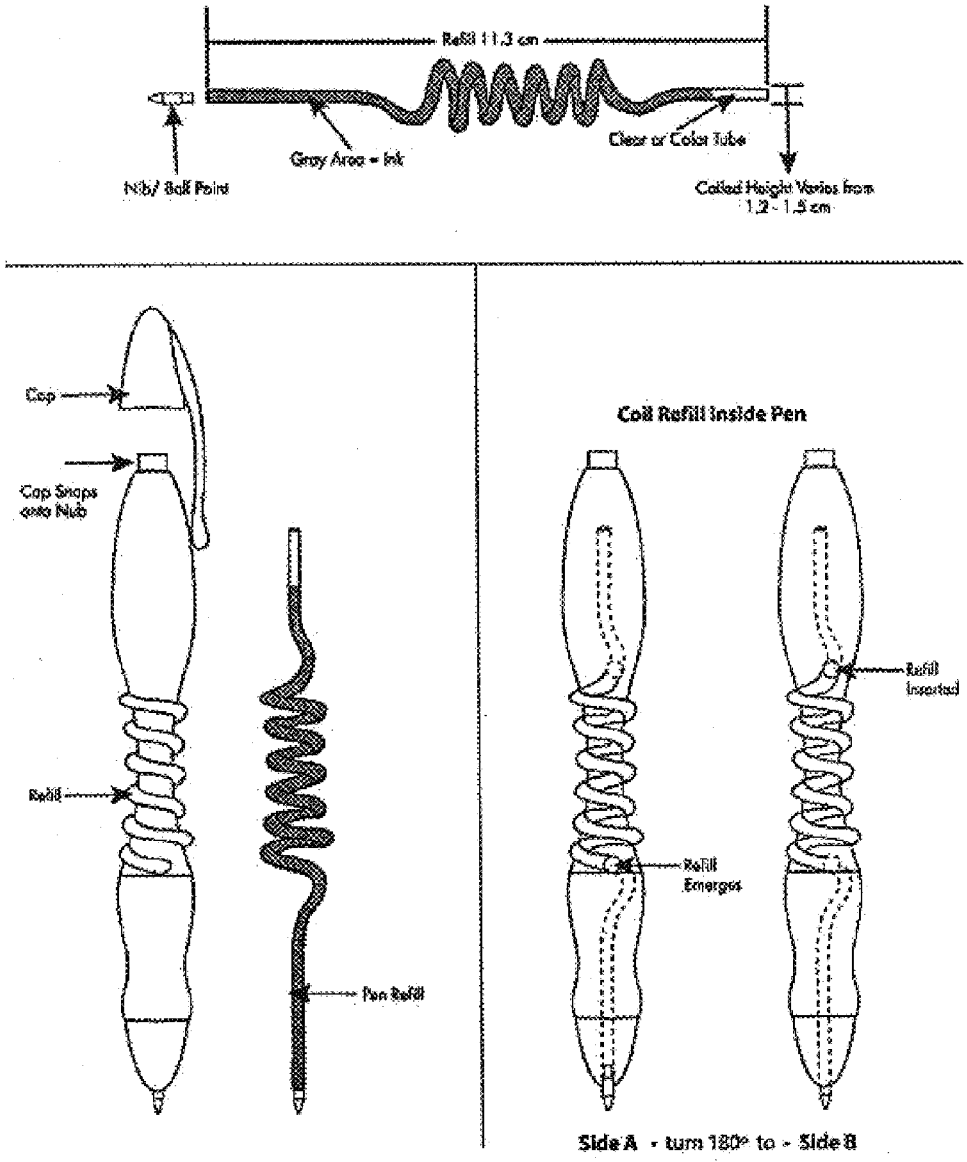
FIG. 5 illustrates the invention as it may be applied to the exterior of the barrel of the writing instrument.

The device of the present invention may be inserted within a conventional writing instrument barrel, see FIGS. 3 and 4, or may be applied to exterior of a writing instrument. See FIG. 5. When applied to the exterior of the instrument barrel, the device may run the entire length of the barrel or any portion thereof. The invention may be applied to the exterior of the writing instrument near the writing instrument tip or point in order to serve as a grip for the user.

The cartridge can also be manufactured as an individual unit which permits it to he transferred from one writing instrument to another or the cartridge may also be permanently affixed to a writing instrument during the manufacturing process.

It may be noted that this invention can be utilized on items other than ball point pens such as highlighters, markers, gel ink pens and the like. See FIG. 4.

The cartridge tube may be clear or translucent to allow the ink to show through. Variations of the transparency or translucency of the refill may include sparkle or glitter, for example. The refill may also be colored and opaque.

A method of making an ink-delivering device for a writing instrument, comprises the following essential steps:

(a) extruding a plastic tube by a machine;

(b) bending or curling the plastic tube to conform to a cartridge configuration;

(c) inserting a nib piece into the plastic tube;

(d) injecting ink into the plastic tube;

(e) eliminating air from the tube by centrifugal process; and (f) assembling the tube, nib and other parts to perform as a device delivering continuous and consistent flow of ink by gravity to the writing tip of a writing instrument.

Of course, having learnt the teachings of the present invention, one skilled in the art may vary the manufacturing process in different ways to meet the objectives of the present invention.

Example embodiments of the present invention have now been described in accordance with the above advantages. It will be appreciated that these examples are merely illustrative of the invention and not limitations thereof Many variations and modifications will be apparent to those skilled in the art and all such modifications and variations are included within the purview and scope of the appended claims.

What is claimed is:

1. A writing instrument comprised of a writing instrument body and a cartridge having ink therein, said ink cartridge comprising at least a portion having other than a straight configuration. A portion of said cartridge wrapped around an exterior of said writing instrument body to form a gripping surface for said writing instrument.

2. The cartridge of claim 1 being in part or whole of spiral, or coiled configuration.

3. The cartridge of claim 2 being of transparent or translucent plastics material.

4. The cartridge of claim 3 containing colored or glittering ink.

5. The cartridge of claim 1 being temporarily or permanently affixed to said body.

6. The cartridge of claim 1 being filled or refillable with ink.

7. The cartridge of claim 6 providing substantially longer writing life than that obtained from commonly available conventional cartridge on the market.

8. The cartridge of claim 7 affixed to a highlighter, marker or gel ink pen.

9. The cartridge of claim 8 being aesthetically decorative.

* * * * *